United States Patent [19]

Gregory

[11] Patent Number: 4,528,866

[45] Date of Patent: Jul. 16, 1985

[54] RAILWAY LEVER CONNECTING BAR

[76] Inventor: Phillip D. Gregory, 165 Caribou Dr., Youngstown, Ohio 44512

[21] Appl. No.: 441,368

[22] Filed: Nov. 12, 1982

[51] Int. Cl.[3] ..... F16C 7/00; B61C 17/10

[52] U.S. Cl. ..... 74/579 R; 228/173.6; 403/157

[58] Field of Search ..... 74/579 R, 519; 403/157, 403/158, 79; 228/173 R, 173 C, 173 F, 170

[56] References Cited

U.S. PATENT DOCUMENTS

| | | | |
|---|---|---|---|
| 1,435,720 | 11/1922 | McGahey | 74/579 X |
| 1,470,120 | 10/1923 | Schaefer | 74/579 R |
| 1,615,821 | 2/1927 | Anderson | 74/579 R |
| 1,647,252 | 11/1927 | Russell | 74/579 R |
| 1,657,875 | 1/1928 | Wright | 74/579 R |
| 2,628,136 | 2/1953 | Pittman | 74/579 X |
| 2,815,232 | 8/1953 | Hill et al. | 403/79 X |
| 3,462,179 | 8/1969 | Hinkle | 403/157 |
| 3,468,007 | 9/1969 | Nakamura | 74/579 |
| 3,538,574 | 11/1970 | Toma et al. | 74/579 E |
| 4,159,187 | 6/1979 | Cale | 403/157 |
| 4,300,410 | 11/1981 | Raghupathi et al. | 74/579 R |

FOREIGN PATENT DOCUMENTS

| | | | |
|---|---|---|---|
| 872452 | 4/1953 | Fed. Rep. of Germany | 403/157 |

*Primary Examiner*—Kenneth J. Dorner
*Assistant Examiner*—Rodney M. Lindsey
*Attorney, Agent, or Firm*—Harpman & Harpman

[57] ABSTRACT

A brake lever connecting bar is formed from a tube, the ends of which become jaws by the insertion of a preformed insert that engages the parallel side walls of the tube increasing the wall thickness in which bearing surfaces are then cut. The remaining parallel tube walls are notched defining the reinforced jaw configuration required to connect brake levers on a typical railway car brake mechanism.

2 Claims, 11 Drawing Figures

RAILWAY LEVER CONNECTING BAR

BACKGROUND OF THE INVENTION (1) Field of the Invention

This invention relates to brake lever connecting bars of the type normally used on railway cars to pivotally connect two brake levers of a railway car brake rigging together. In use, the connection is made either across the top or bottom of the car-truck bolster or sometimes through the bolster itself. In some applications the center portion of the connector is offset in relation to the ends for clearance purposes.

(2) Description of the Prior Art

Prior art devices that address the problem of brake lever connecting bars of the type normally used on railway cars to pivotally connect two brake levers of a railway car brake rigging together, can be seen in the following U.S. patents. U.S. Pat. Nos. 557,122, 1,470,120 and 4,159,187.

In U.S. Pat. No. 557,122 entitled "A Bottom Bar for Brake Levers" discloses a bar formed from two pressed and forged bars secured together by a plurality of fasteners. This patent discloses a bar having a bifurcated ends which are fabricated from multiple pieces which appears to be one method of forming such a brake lever without casting as is presently used.

In U.S. Pat. No. 1,470,120, a connecting rod is disclosed formed from a tubular body, the opposite ends of which have been split apart so that a U-shaped yoke can be inserted within the split ends which are then reshaped around the yoke. This patent is cited as prior art as showing a method of fabricating a bifurcated reinforced end from a tubular member attempting to solve the same problem that applicant addresses in this patent application.

Finally in U.S. Pat. No. 4,159,187, a five-piece brake lever connection device is disclosed wherein separate jaw portions are formed separately and welded to oppositely disposed ends of a rod-like portion 10. This patent again addresses the problem of forming a brake lever connecting rod from multiple pieces rather than a casting. The jaws are positioned in the ends of the tubular member and as such is considered relevant to applicant's disclosure.

Applicant's device utilizes a tubular member with jaws formed in oppositely disposed ends by the use of a preformed insert that effectively increases the side wall thickness of the tubular member to provide the required bearing surfaces. The insert does not distort or enlarge the tube and the remaining non-reinforced walls of the tube ends are cutaway to provide clearance for the brake levers.

SUMMARY OF THE INVENTION

A brake lever connecting bar for use on railway car brake assemblies comprises a tubular member, the ends of which have preformed inserts that increase the side wall thickness into which bearing surfaces are cut. The remaining end wall portions are cut away for clearance of the brake lever. The jaw configurations are pivotally connected to the ends of the brake levers securing them together as is required in the art.

DESCRIPTION OF THE PREFERRED EMBODIMENT

Figure 1:
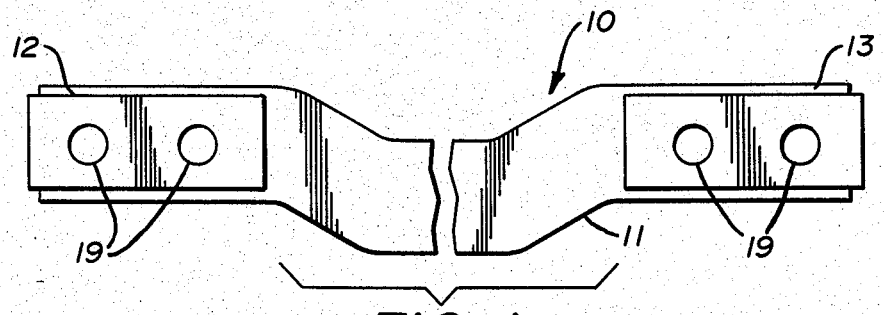
FIG. 1 is a front plan view of the connecting bar with parts broken away.
Figure 2:
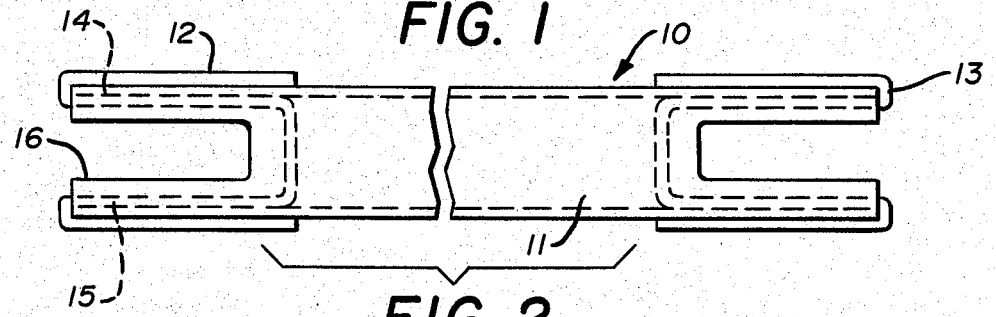
FIG. 2 is a top plan view of the connecting bar with parts broken away.
Figure 3:
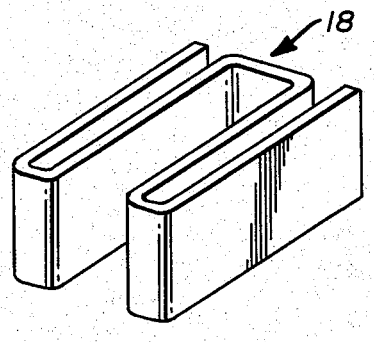
FIG. 3 is a perspective view of a connecting bar insert.
Figure 4:
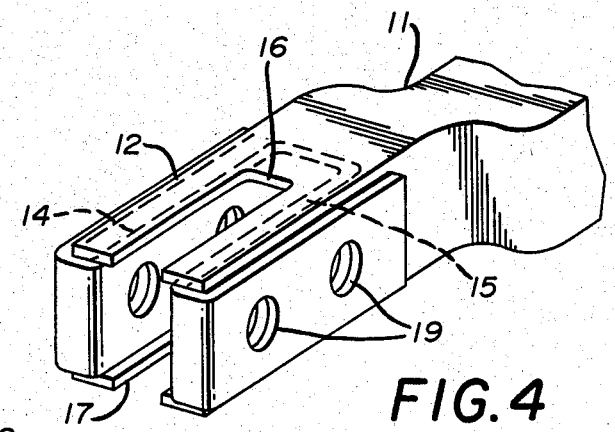
FIG. 4 is a perspective view of the connecting bar with a portion broken away.

Referring to FIGS. 1-4 and 11 of the drawings, a brake lever connector bar 10 can be seen comprising an elongated tubular member 11, having end portions which are offset in relation to the axis of the tubular member. The end portions of the tubular member 11 defines jaws 12 and 13 having oppositely disposed sidewalls 14 and 15 with notches in upper and lower areas 16 and 17. The side walls 14 and 15 are reinforced on both the interior and exterior surface by a preformed insert 18 as best seen in FIG. 3 of the drawings. The insert 18 is comprised of a flat bar bent in a generally W-shaped spaced parallel extentension configuration that is partially engaged in each end portion of the member 11 to greatly increase the thickness of the sidewalls 14 and 15 as seen in FIGS. 2 and 4 of the drawings.

Registering openings 19 are cut through the insert 18 and the side walls 14 and 15 completing the jaws 12 and 13 on the oppositely disposed end portions of the tubular member 11.

Figure 11:
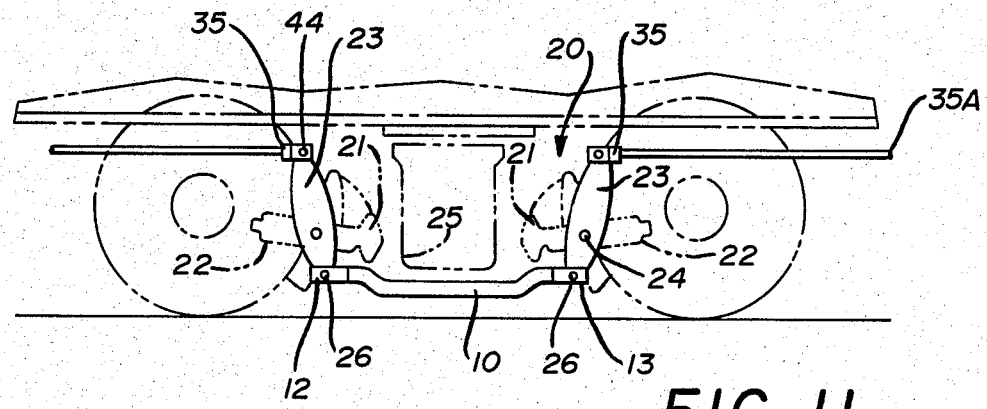
FIG. 11 is a side view of a brake rigging containing the brake lever connection.

Referring now to FIG. 11 of the drawings, the brake lever connecting rod 10 can be seen on a railway car truck 20 of conventional construction comprising a pair of brake beams 21, each of which has a central strut 22 that extends lengthwise of the car with an inclined slot therethrough. A brake lever 23 extends through the strut slot and is held in place by pivot pins 24. The brake lever connecting rod 10 connects the lower ends of the brake levers 23 and extends beneath a truck bolster 25. The jaws 12 and 13 of the brake lever connecting rod 10 movably engage the ends of the brake lever 23 by pivot pins 26 which extend through the openings 19 therein.

Figure 5:
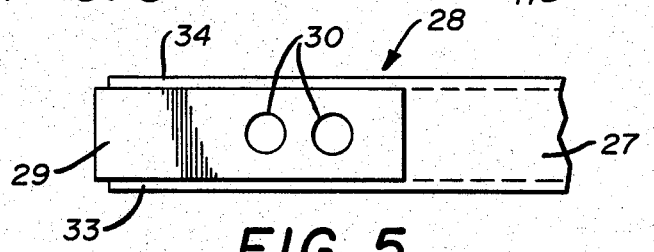
FIG. 5 is a front view of an alertnate form of the connecting bar with parts broken away.
Figure 6:
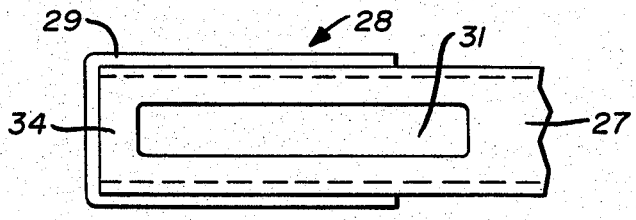
FIG. 6 is a top plan view of the alternate form of the connecting bar with parts broken away.
Figure 7:
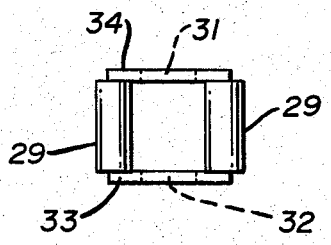
FIG. 7 is an end plan view of the alternate form.
Figure 8:
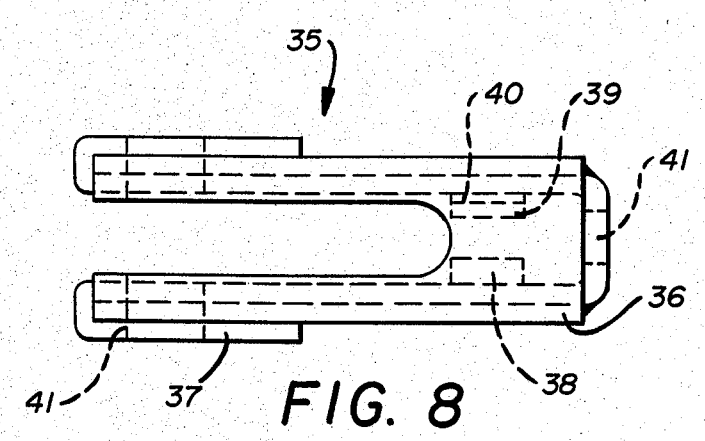
FIG. 8 is a top plan view of a second alternate form.
Figure 9:
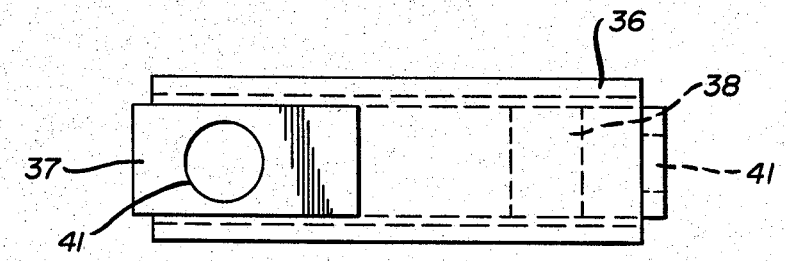
FIG. 9 is a front plan view of the second alternate form.

Referring to FIGS. 5, 6 and 7 of the drawings, an alternate form of the invention can be seen wherein a portion of a tubular member 27 has a modified jaw 28 formed on one end thereof. The jaw 28 comprises a preformed U-shaped fitting 29 having a thickness greater than the insert 18 hereinbefore described. The U-shaped fitting 29 is secured externally on the ends of the tubular member effectively increasing the overall sidewall thickness into which openings 30 are cut. A pair of oppositely disposed slots 31 and 32 are cut in the remaining top and bottom walls 33 and 34 to provide clearance for the brake lever 23 as hereinbefore described.

Figure 10:
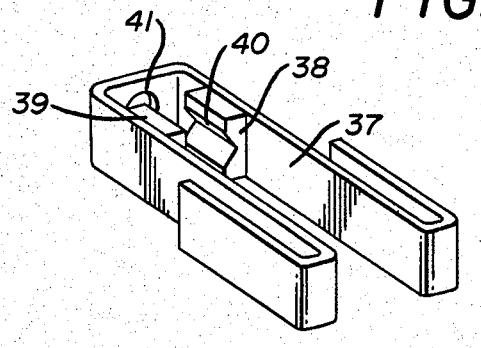
FIG. 10 is a perspective view of an insert used in the second alternate form of the invention.

Referring now to FIGS. 8, 9, 10 and 11 of the drawings, a second alternate form of the invention can be seen wherein a universal connector jaw 35 that is used on the ends of a connecting rod 35A comprises a short length of a tubular member 36 into which is secured a preformed generally U-shaped reinforcing member 37 having a pair of alignment blocks 38 and 39 secured thereto in oppositely disposed relation to one another as best seen in FIG. 10 of the drawings. Each of the alignment blocks 38 and 39 has a V-shaped configuration 40 on their outer adjacent surfaces defining a restricted area therebetween. A rod opening 41 in the end of the insert 36 adjacent the alignment blocks 38 and 39 provides access for the connecting rod 35A. The connecting rod 35A passes between the alignment blocks 38 and 39 effectively restricting the rods lateral movement and is secured to the jaw 35 by welding. An opening 43 is cut in the finished jaws to accept a pivot pin 44 movably securing the same to the brake lever 23.

Thus it will be seen that a new and useful railway brake lever connecting rod has been illustrated and described and it will be apparent to those skilled in the art that various changes and modifications may be made herein without departing from the spirit of the invention and having thus described my invention what I claim is:

1. A brake lever connecting bar consisting of a tube with oppositely disposed elongated notches in end portions thereof defining oppositely disposed side walls, a jaw on each of said end portions of said tube, each of said jaws comprising said oppositely disposed side walls of said end portions and a W-shaped insert having spaced parallel sections, said oppositely disposed side walls of said end portions having inner and outer surfaces, said spaced parallel sections of said W-shaped insert engaging said inner and outer surfaces of said oppositely disposed side walls of said end portions so as to reinforce the same, pivot pins positioned in registering openings in said spaced parallel sections of said insert and said oppositely disposed side walls and means for securing said insert in each of said end portions of said tube.

2. The brake lever connecting bar of claim 1 wherein said W-shaped insert is preformed and the spaced parallel sections thereof are of different lengths so as to be engagable in registry with different areas of said inner and outer surfaces of said oppositely disposed side walls and wherein said insert is of a uniform width that is registrable within the end portions of said tube.

* * * * *